United States Patent [19]

Laibach et al.

[11] 4,193,133

[45] Mar. 18, 1980

[54] DETACHABLE HELMET GOGGLE BRACKET

[75] Inventors: Friedrich Laibach, Haan; Paul Hoebink, Solingen, both of Fed. Rep. of Germany

[73] Assignee: Fondermann & Co., Haan, Fed. Rep. of Germany

[21] Appl. No.: 895,198

[22] Filed: Apr. 10, 1978

[30] Foreign Application Priority Data

Apr. 12, 1977 [DE] Fed. Rep. of Germany ... 7711402[U]

[51] Int. Cl.[2] ..... A61F 9/00; A44B 11/04

[52] U.S. Cl. ..... 2/10; 24/79; 24/3 R

[58] Field of Search ..... 24/79, 3 R; 2/10, 13, 2/424

[56] References Cited

U.S. PATENT DOCUMENTS

| | | | |
|---|---|---|---|
| 712,098 | 10/1902 | Schrum | 24/79 |
| 768037 | 8/1904 | Fearns | 24/79 |
| 804,905 | 11/1905 | Weaver | 24/79 |
| 815,125 | 3/1906 | Long | 24/79 |
| 1,230,886 | 6/1917 | George | 24/79 |
| 3,703,750 | 11/1972 | Irwin | 2/10 |
| 3,781,915 | 1/1974 | Menold | 2/10 |
| 3,808,604 | 5/1974 | Rose | 2/10 |

*Primary Examiner*—Bernard A. Gelak
*Attorney, Agent, or Firm*—John C. Smith, Jr.

[57] ABSTRACT

A generally U-shaped bracket for detachably securing in particular a resilient retaining strap of safety goggles to a safety helmet having a rim is provided. The bracket is made of flexible material, has two limbs and comprises a two-armed clamp lever for detachably clamping the bracket to the rim of the safety helmet. The clamp lever has a passage through which the retaining strap of the safety goggles placed about the safety helmet passes. One of the limbs of the bracket has a bifurcation defining bifurcated ends and the two-armed clamp lever is pivotally mounted in and between said bifurcated ends.

10 Claims, 4 Drawing Figures

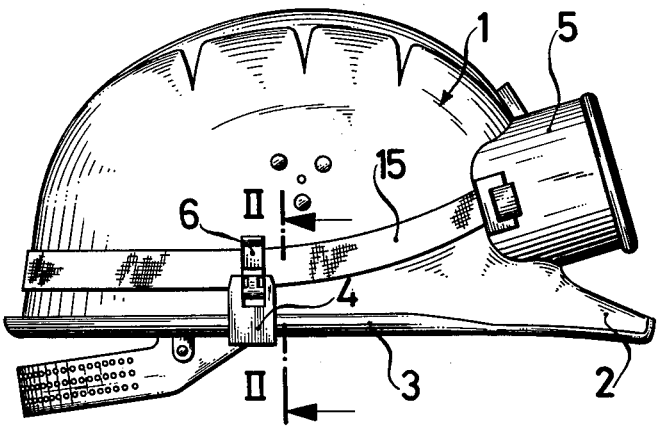
FIG.1
FIG. 2
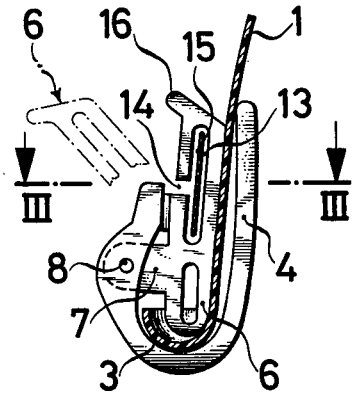
FIG.3
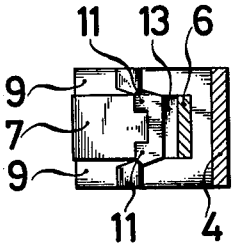
FIG. 4
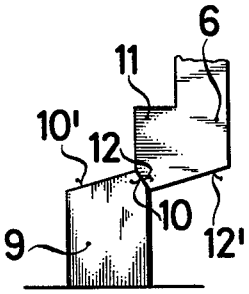

DETACHABLE HELMET GOGGLE BRACKET

BACKGROUND OF THE INVENTION

This invention relates to a generally U-shaped bracket for detachably securing in particular a resilient retaining strap of safety goggles to a safety helmet, said bracket being appliable to the rim of the safety helmet and being clampable to the rim by means of a clamp lever having a passage through which the retaining strap of the safety goggles placed about the safety helmet passes. Such brackets are arranged at both sides of the safety helmet.

With a conventional bracket which is known from German Utility Model No. 7,116,767, the attachment thereof to the safety helmet is effected by means of a retaining strap placed about the safety helmet, said strap being guided in the bracket. The bracket is displaceable on the retaining strap and arrestable in the adjusted position. The connection of the safety goggles to the two brackets is effected by means of coiled tension springs which with their one ends are secured to the safety goggles and with their other ends to the brackets, or by means of lever linkages pivoted to the safety goggles on the one hand and to the brackets on the other hand. This attachment of the bracket to the safety helmet as well as the connection of the safety goggles to the bracket is relatively complicated, however.

It is furthermore already known from German Utility Model No. 7,523,571 to use a frame of a U-shaped cross section consisting of resilient material for the attachment of the safety goggles to the safety helmet, said frame clampingly encompassing the rim of the safety helmet resiliently. The frame does not require any additional attachment to the safety helmet, but it brings about the disadvantage that thereby the weight of the safety helmet is not immaterially increased and the safety goggles at the frame are not able to be adjusted in relationship to the bearer of the safety goggles.

Also, a bracket produced by the firm to Focus Veilig B.V. Middleburg in the Netherlands and including a one-armed clamp lever is known which is provided for protective shields. By means of the clamp lever which is pivoted to one end of the bracket, the bracket is capable of being clamped tight to the rim of the safety helmet. The bracket brings about the material disadvantage, however, that its attachment to a safety helmet having no rain gutter is insufficient as a result of the narrow rim of the safety helmet. Furthermore, the relatively long clamp lever is projecting relative to the safety helmet, and thereby a striking of the safety helmet or the clamp lever against objects and thus an endangerment of the bearer of the safety helmet not being able to be precluded.

SUMMARY OF THE INVENTION

It is the object of the present invention to avoid these disadvantages and to improve the known brackets of the initially referred to species serving the attachment in particular of safety goggles to a safety helmet in their structure and in relationship to their attachment to the safety helmet.

To attain this object the present invention provides a generally U-shaped bracket for detachably securing in particular a resilient retaining strap of safety goggles to a safety helmet having a rim, said bracket being made of flexible material, having two limbs and comprising a two-armed clamp lever for detachably clamping the bracket to the rim of the safety helmet, said two-armed clamp lever having a passage through which the retaining strap of the safety goggles placed about the safety helmet passes, one of the limbs of the bracket having a bifurcation defining bifurcated ends and the two-armed clamp lever being pivotally mounted in and between said bifurcated ends.

The two-armed clamp lever rests with its one arm on the rim of the safety helmet in the clamping position and clamps with its other arm the hood-shaped portion of the safety helmet between itself and the other limb of the bracket. Thereby, even for a safety helmet which in contradistinction to one having a rain gutter only has a narrow rim a reliable, unshiftable securing of the bracket at the safety helmet is ensured. The bracket proposed by the invention furthermore excels itself over the conventional brackets provided with a clamp lever in that it defines a self-contained unit with the clamp lever.

An advantageous embodiment of the invention is one in which the bifurcated ends of the bracket internally each may have two longitudinally extending inclined surfaces defining an angle and one arm of the two-armed clamp lever may have on its one broad face two opposing, elongated jaws projecting lengthwise relative to the arm, said jaws having inclined countersurfaces surfaces at the projecting faces, related to the inclined surfaces of the bifurcated ends.

Thereby, in a simple way the clamp lever is retained in its clamping position in that upon pivoting the clamp lever into the clamping position by the coaction of the one inclined surfaces disposed at the bifurcated ends of the bracket with the one inclined countersurfaces disposed at the clamp lever the bifurcated ends are expanded so that the clamp lever may be pivoted unobstructedly through the bifurcated ends into the clamping position, the bifurcated ends upon reaching said clamping position recoiling into the initial position again, in doing so engaging with their other inclined surfaces the adjacent inclined countersurfaces of the clamp lever and thereby retaining it in the clamping position. In just as simple a way the clamp lever may be released from its clamping position again in that upon pivoting the clamp lever into the initial position the bifurcated ends of the bracket are again expanded and thereby release the clamp lever.

BRIEF DESCRIPTION OF THE DRAWING

An embodiment of the invention will now be described by way of example and with reference to the accompanying drawing, in which:

FIG. 1 is a side elevational view of a bracket according to the present invention and of safety goggles secured to a safety helmet;

FIG. 2 is a sectional view, on an enlarged scale, taken on the line II—II of FIG. 1;

FIG. 3 is a sectional view taken on the line III—III of FIG. 2, and

FIG. 4 is a diagrammatic illustration of the securing of the clamp lever of the bracket in the clamping position.

FIG. 1 shows a hood-shaped safety helmet 1 which has a peak 2 and a rim. The rim of the safety helmet 1 is formed to define a rain gutter 3. The reference numeral 4 designates a generally U-shaped bracket which consists of flexible material and is applicable to the rim of the safety helmet 1 or to the rain gutter 3 and serves to connect safety goggles 5 to the safety helmet 1. A bracket 4 is arranged at both sides of the safety helmet 1.

As shown in FIGS. 2 and 3 each of the brackets 4 has in one of its limbs a bifurcation defining bifurcated ends 9 and is associated with a two-armed clamp lever 6. The clamp lever 6 has a thickened portion 7 on one of its broad faces, at the free ends of which thickened portion there are spigots 8 which are integral with the thickened portion 7 and by means of which the clamp lever 6 is pivotably supported in and between the bifurcated ends 9 of the bracket 4. As shown in FIG. 4, the bifurcated ends 9 of the bracket 4 internally each have two lengthwise extending inclined surfaces 10 and 10' defining a blunt angle. The longer arm of the clamp lever 6 on its broad face has two opposing elongated jaws 11 integral with the clamp lever 6, said jaws projecting lengthwise relative to the arm.

The jaws 11 have at their projecting longitudinal faces, related to the inclined surfaces 10 and 10', inclined countersurfaces 12 and 12' defining a blunt angle. The longer arm of the clamp lever 6 furthermore has an elongated passage 13 the one wall of which is provided with a transverse slot 14 (FIG. 2). The safety goggles 5 are provided with a resilient retaining strap 15 which is secured with its ends to the safety goggles 5. The retaining strap 15 placed about the safety helmet 1 is passed and guided through the passage 13 of each bracket 4 and is insertable through the transverse slot 14 into the passage 13. The upper end of the longer arm of the clamp lever 6 defines a handle 16. The lower end of the shorter arm of the clamp lever 6 is rounded.

Prior to pushing the bracket 4 onto the rain gutter 3 of the safety helmet 1, the clamp lever 6 is pivoted so far outwardly that the bracket 4 can be pushed onto the rain gutter 3 without being obstructed by the clamp lever 6. Thereafter, the clamp lever 6 is pivoted in direction to the hood-shaped portion of the safety helmet 1, and in doing so it slides along the wall of the safety helmet 1 with the rounded end of its shorter arm in flexing apart the bracket 4. In doing so, the clamp lever 6 engages with its inclined countersurfaces 12' the inclined surfaces 10' of the bifurcated ends 9, the latter thereby being expanded. When the clamp lever 6 has reached the clamping position in which it rests with its lower shorter arm on the rain gutter 3 and clamps tight with its upper longer arm the hood-shaped portion of the safety helmet 1 between itself and the other limb of the bracket 4, it releases the bifurcated ends 9 of the bracket 4 with its inclined countersurfaces 12. The result thereof is that the previously stressed and now relieved bifurcated ends 9 engage the inclined countersurfaces 12 of the clamp lever 6 with their inclined surfaces 10 and secure the clamp lever in the clamping position. When the clamp lever 6 is to be released from its clamping position again, upon pulling on the clamp lever 6 as a result of the coaction between the inclined countersurfaces 12 of the clamp lever 6 and the inclined surfaces 10 of the bifurcated ends 9 the latter are expanded to such an extent that the inclined countersurfaces 12 are released from the inclined surfaces 10, the clamp lever 6 thereafter being able to be pivoted into the initial position unobstructedly.

This invention of course is not limited in its use to the retaining of safety goggles at safety helmets. Rather, by means of the bracket according to the invention for instance also face protection shields or the like may be connected to the safety helmet.

What is claimed is:

1. A bracket for detachably securing a retaining strap of safety goggles to a safety helmet having a rim projecting laterally about at least a portion of said helmet, said bracket comprising (a) a resilient U-shaped member having a U-portion and a pair of spaced limbs extending therefrom and adapted to extend about said rim with said U-portion contacting said rim and said limbs extending along the interior and exterior sides of said helmet;

(b) one of said limbs, adapted to extend along the exterior side of said helmet, being bifurcated providing spaced bifurcated ends; and (c) a clamp lever pivotally mounted between said bifurcated ends of said one limb of said U-shaped member and including at least one elongated arm, said clamp lever defining a passage through which said retaining strap of said safety goggles extending about said safety helmet passes;

(d) said clamp lever including said arm being adapted to pivot between an initial position wherein said rim of said safety helmet may be passed between said limbs and into contact with said U-portion of said member and a locking position wherein said one arm is pressed against the exterior side of said helmet and projects towards said U-portion of said member such that said rim of said helmet is retained between the end of said one arm and said U-portion of said member.

2. A bracket as set forth in claim 1 wherein a pair of spaced confronting surfaces of said bifurcated ends of said U-shaped member and a pair of spaced surfaces of said clamp lever are arranged to respectively engage each other in a biased manner to releasably secure said clamp lever in said locking position.

3. A bracket as set forth in claim 2 wherein each surface of at least one of said pairs of surfaces has a tapered convex configuration, said tapered convex surfaces being adapted to cause said bifurcated ends of said U-shaped member to spread further apart from their normal positions as said clamp lever is moved therebetween and to permit said bifurcated ends to return towards their normal positions when said clamp lever is in said locking position to releasably retain said clamp lever in said locking position.

4. A bracket as set forth in claim 2 wherein said clamp lever comprises a pair of arms adapted to press against the exterior side of said helmet when said clamp lever is in said locking position, one of said arms having means to manually engage and pivot said clamp lever between said initial and locking positions.

5. A bracket as set forth in claim 4 wherein one of said arms comprises a pair of spaced jaws, each having a surface of tapered convex configuration, arranged to engage said pair of confronting surfaces of said bifurcated ends of said U-shaped member.

6. A safety helmet comprising in combination:

(a) a generally hood-shaped member;

(b) a rim projecting laterally about at least a portion of said hood-shaped member;

(c) safety goggles;

(d) a strap extending from said goggles about said hood-shaped member to retain said goggles; and (e) a bracket detachably secured to said hood-shaped member for securing said retaining strap to said hood-shaped member, said bracket comprising:

(i) a resilient U-shaped member having a U-portion and a pair of spaced limbs extending therefrom and adapted to extend about said rim with said U-portion contacting said rim and said limbs extending along the interior and exterior sides of said hood-shaped member;

(ii) one of said limbs, adapted to extend along the exterior side of said hood-shaped member, being bifurcated providing spaced bifurcated ends; and (iii) a clamp lever pivotally mounted between said bifurcated ends of said one limb of said U-shaped member and including at least one elongated arm, said clamp lever defining a passage through which said retaining strap of said safety goggles extending about said hood-shaped member passes;

(iv) said clamp lever including said arm being adapted to pivot between an initial position wherein said rim of said hood-shaped member may be passed between said limbs and into contact with said U-portion of said member and a locking position wherein said one arm is pressed against the exterior side of said hood-shaped member and projects towards said U-portion of said member such that said rim of said hood-shaped member is retained between the end of said one arm and said U-portion of said member.

7. A safety helmet as set forth in claim 6 wherein a pair of spaced confronting surfaces of said bifurcated ends of said U-shaped member and a pair of spaced surfaces of said clamp lever are arranged to respectively engage each other in a biased manner to releasably secure said clamp lever in said locking position.

8. A safety helmet as set forth in claim 7 wherein each surface of at least one of said pairs of surfaces has a tapered convex configuration, said tapered convex surfaces being adapted to cause said bifurcated ends of said U-shaped member to spread further apart from their normal positions as said clamp lever is moved therebetween and to permit said bifurcated ends to return towards their normal positions when said clamp lever is in said locking position to releasably retain said clamp lever in said locking position.

9. A safety helmet as set forth in claim 7 wherein said clamp lever comprises a pair of arms adapted to press against the exterior side of said hood-shaped member when said clamp lever is in said locking position, one of said arms having means to manually engage and pivot said clamp lever between said initial and locking positions.

10. A safety helmet as set forth in claim 9 wherein one of said arms comprises a pair of spaced jaws, each having a surface of tapered convex configuration arranged to engage said pair of confronting surfaces of said bifurcated ends of said U-shaped member.

* * * * *